United States Patent [19]

Salisbury

[11] Patent Number: 4,805,774

[45] Date of Patent: Feb. 21, 1989

[54] SUPPORT LOG FOR SHIPPING SHEET MATERIAL

[76] Inventor: John W. Salisbury, 31746 Staman Cir., Farmington Hills, Mich. 48018

[21] Appl. No.: 90,207

[22] Filed: Aug. 27, 1987

[51] Int. Cl.[4] ..... B65D 85/48

[52] U.S. Cl. ..... 206/454; 206/453; 206/460; 206/448; 211/41

[58] Field of Search ..... 206/448, 449, 451, 452, 206/453, 454, 460, 586, 813; 211/41

[56] References Cited

U.S. PATENT DOCUMENTS

| | | | |
|---|---|---|---|
| 2,919,022 | 12/1959 | Lidgard . | |
| 2,953,253 | 9/1960 | Henderson et al. | 211/41 |
| 3,043,488 | 7/1962 | Warwick | 206/586 |
| 3,133,687 | 5/1964 | Fremion | 229/14 |
| 3,147,860 | 9/1964 | Kean, Sr. et al. | 206/62 |
| 3,362,609 | 1/1968 | Freedy | 206/454 |
| 3,385,462 | 5/1968 | Deldime et al. | 214/10.5 |
| 3,403,778 | 10/1968 | Voytko et al. | 206/62 |
| 3,414,124 | 12/1968 | Lidgard | 206/62 |
| 3,653,496 | 4/1972 | Roberts | 206/586 |
| 3,809,234 | 5/1974 | Kurick | 206/448 |
| 3,938,660 | 2/1976 | Moehring | 206/451 |
| 3,948,436 | 4/1976 | Bambara | 206/523 |
| 3,973,720 | 8/1976 | Schmid | 206/523 |
| 3,995,738 | 12/1976 | Rowley et al. | 206/451 |
| 4,051,549 | 9/1977 | Fiege | 211/41 |
| 4,053,049 | 10/1977 | Beauvais | 206/460 |
| 4,182,450 | 1/1980 | Kryger | 206/454 |
| 4,202,452 | 5/1980 | McCormick | 206/454 |
| 4,209,091 | 6/1980 | Lieberman | 206/460 |
| 4,225,043 | 9/1980 | Lastik | 206/448 |
| 4,240,240 | 12/1980 | Cohen | 206/523 |
| 4,287,990 | 9/1981 | Kurick | 206/448 |
| 4,315,711 | 2/1982 | Koscho | 414/97 |
| 4,317,517 | 3/1982 | Tisdale | 206/586 |
| 4,353,466 | 10/1982 | Pater | 206/454 |
| 4,368,822 | 1/1983 | Kramer et al. | 211/41 |
| 4,413,735 | 11/1983 | Little | 206/523 |
| 4,489,835 | 12/1984 | Tombal et al. | 206/448 |
| 4,545,482 | 10/1985 | Novatny | 206/586 |

*Primary Examiner*—David T. Fidei

*Attorney, Agent, or Firm*—Gifford, Groh, Sheridan, Sprinkle and Dolgorukov

[57] ABSTRACT

A shipping log for supporting a plurality of sheet members such as automotive lites. The shipping log has a plurality of vertical slots to maintain the sheet members in a spaced apart vertical alignment and a resilient formable strip extending across a plurality of grooves and deformable into the grooves under the weight of the sheet members to prevent longitudinal displacement of the sheet members.

5 Claims, 1 Drawing Sheet

SUPPORT LOG FOR SHIPPING SHEET MATERIAL

BACKGROUND OF THE INVENTION

I. Field of the Invention

This invention relates to slotted logs for shipping frangible sheet material and more particularly, for a slotted log for use in shipping containers for automotive lites.

II. Description of the Prior Art

Heretofor, many different types of shipping containers have been used to transport and store sheet materials, such as automotive lites, on edge. U.S. Pat. No. 4,225,043 to Lastik discloses folding a resilient compressible pad over an edge portion of a sheet of glass and wedging the folded pad and the sheet into slots of a pair of elongated logs of a shipping container. The pad is, thus, compressed within the slot to apply a biasing force to hold the sheet securely in position against longitudinal movement within the shipping container during transportation. Lastik, alternatively, discloses lining each slot of the log with a resilient pad prior to insertion of the sheet into the slot. However, folding the pads over the sheet or lining the slots with the resilient pad is time consumming and labor intensive, thereby rendering this method quite costly.

U.S. Pat. No. 4,353,466 to Pater discloses shipping logs having a sheet edge supporting surface extending between a pair of upright members having wedge or scalloped portions to form a plurality of V-shaped recesses transverse to the longitudinal axis of the log. A strip of resilient material having an adhesive surface facing upwardly is secured to the supporting surface. A sheet is aligned in the recesses with a bottom edge surface contacting the adhesive surface of the strip to prevent movement of the sheet material. A spacer assembly is mounted along a top edge of the sheets to space apart the sheets. A strap extends from a bottom portion of the container over the spacer assembly to secure the sheets in a vertical position and to the bias sheets downwardly to maintain the bottom edge portions of the sheet in continuous contact with adhesive surface of the strip to prevent longitudinal motion of the sheets. However, formulation of logs having wedge or scalloped portions is expensive and requires the installation of customized machinery. Additionally, the straps must be connected and properly tensioned to provide the necessary biasing against the log.

SUMMARY OF THE PRESENT INVENTION

This invention relates to a support log for use with a shipping container in shipping and storing sheet material such as curved auto lites. The elongated log has a generally U-shaped cross section having a center portion having a planar surface disposed between a pair of upwardly extending arm portions. A plurality of slots extend downwardly and transversely through the pair of arm portions to form a plurality of support portions. Each of the pair of arms has a rectangular cut extending downwardly to a bottom surface below the level of the planar surface to form one slot. Between each respective cut of one of the plurality of slots is a groove extending through the planar surface of the center portion of the log. A deformable resilient strip having an adhesive coating on both a top and a bottom surface is affixed to the planar surface to extend across each of the grooves. One sheet is lowered into one of the slots until a bottom edge of the sheet engages the top surface of the strip and deforms a portion of the strip into the groove. The sheet extends into the groove to compress the deformed portion of the strip between the sides and bottom edge of the sheet and the surfaces forming the groove. The sheet is compressibly and adhesively maintained by the compressed portion of the strip to resist longitudinal movement of the sheet material while it is being transported. The sheet material is supported in an upright position by the support portions of each arm portion defined by the plurality of slots.

It is, therefore, an object of this invention to provide a log for supporting sheet material having an adhesive strip deformable into a groove to engage a bottom edge and each side of a sheet.

It is another object of the invention to provide a support log for shipping which may be simply and inexpensively formed.

It is yet another object of the invention to provide a support log for shipping which may be simply and quickly loaded.

BRIEF DESCRIPTION OF THE PREFERRED EMBODIMENT

Figure 1:
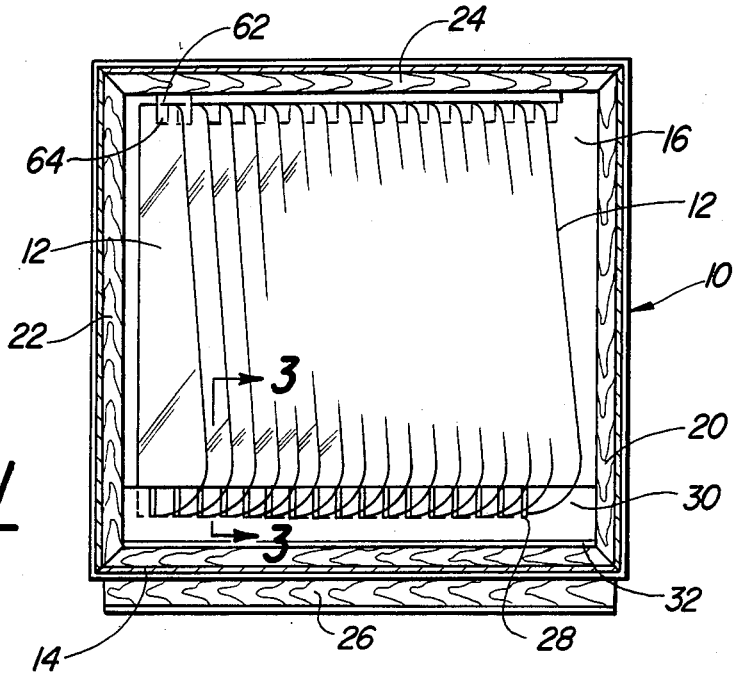
FIG. 1 is a side view of a container loaded with automotive lites supported by a log in accordance with the teachings of this invention.
Figure 2:
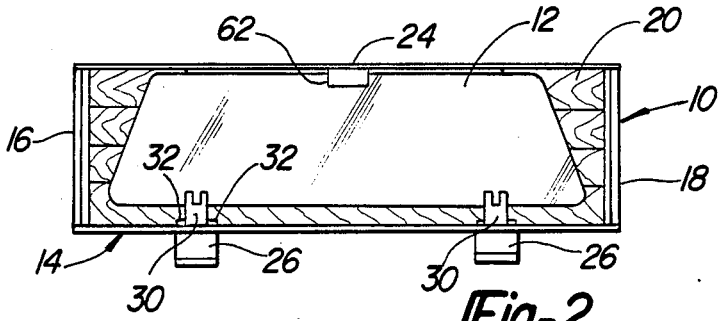
FIG. 2 is a front view of the container having a side panel removed to illustrate showing an automotive lite supported by a pair of logs.

Shown in FIGS. 1 and 2 is a container 10 for shipping and storing a plurality of sheets or automotive lites 12 such as windshields. The container 10 is used for shipping the plurality of lites from a manufacturer to a consumer such as an automobile manufacturer and for storing the lites. When the lites are needed for assembly, the container is placed on a conveyor (not shown) to travel to a work station where the lites are removed from the container for installation in an automobile.

As shown in FIGS. 1 and 2, the container 10 has a base 14, side panels 16 and 18, a back panel 20, a front panel 22 (not shown in FIG. 2) and a top panel 24. The base 14 includes a pair of runners 26 to provide clearance for lifting the container with a fork truck (not shown in the drawing). The container 10 may be formed of any suitable material such as wood as shown in FIGS. 1 and 2, pressed corrugated fiberboard or the like. The front panel 22 and the top panel 24 are typically removable for packing and access to the plurality of lites 12. The number of lites which are packed in the container depends on the curvature of the lites and is typically between 8 and 14 lites.

Figure 3:
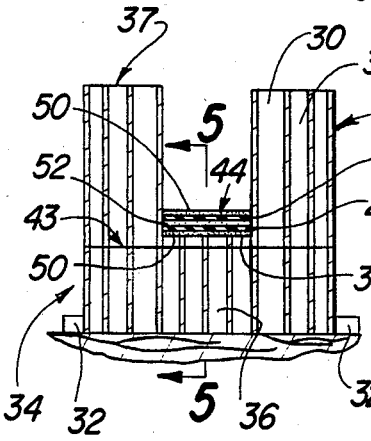
FIG. 3 is a partial sectional view of a log of the invention taken along lines 3—3.

The plurality of lites 12 is supported in the container within a plurality of slots 28 of a pair of support logs 30 as shown in FIG. 1. Each of the pair of logs 30 are restrained from longitudinal movement along the base 14 a pair of cleats 32 extending longitudinally on either side of each of the pair of logs as shown in FIG. 3. The pair of cleats are affixed by fasteners (not shown) to the base 14 and each of the pair of logs is positioned between a pair of cleats. Each of the pair of logs 30, in the preferred embodiment, have a generally U-shaped cross section. In the preferred embodiment, the pair of logs are formed of laminated, pressed, corrugated fiberboard. However, other suitable materials such as wood or foam may be used.

Figure 4:
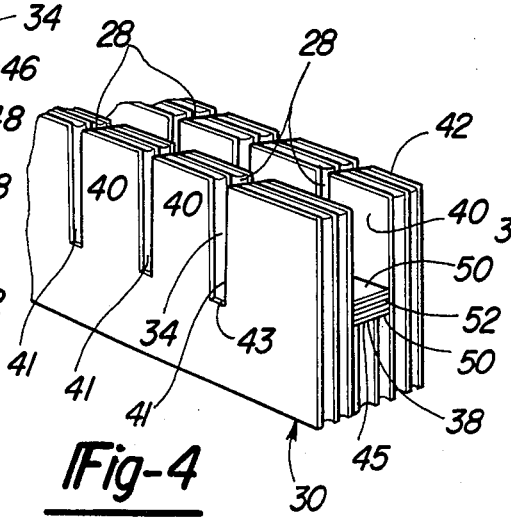
FIG. 4 is a perspective view of the log according to the invention.

Each of the pair of logs has a pair of arms 34 extend upwardly on either side of a central portion 36 having a planar surface 38 extending longitudinally between the pair of arms 34. Each of the plurality of slots 28 extends transversely through the pair of arms to define a plurality of support portions 40, as shown in FIG. 4. Each of the plurality of slots is formed by forming a rectangular slit 41 through the pair of arm portions with a cutting blade or saw. Each slit 41 extends downwardly from a top portion 37 of each of the pair of arms to a bottom surface 43 located below the level of the planar surface 38 as shown in FIG. 3, for a purpose as will be set forth more fully below. Each of the plurality of slots 28 has a width between a pair of side surfaces 39, generally equal to the width of the lite to be supported by the pair of logs 30. Each of the plurality of slots 28 extends transversely on a plane across the pair of arms. The plane may be offset at an angle less than 90° with respect to a longitudinal axis of the log in order to accept a radially curved portion of the windshield. If necessary, the plane may be inclined with respect to a vertical axis to accept a lite.

Extending along the plane of each of the plurality of slots 28 is a groove 42 cut through the planar surface of the center portion 36 of each of the pair of logs 30. The groove 42 extends downwardly from the planar surface 38 to a bottom surface 45 and has a depth "d" generally equal to the width of each of the plurality of lites. Each groove has a width generally equal to the width of the slit 41. Each of the plurality of slots and the respective groove may be formed at the same time by cutting with a saw or the like and are formed so that the bottom surface 43 of each slit 41 is coplanar with the bottom surface 45 of the respective groove 42.

As best shown in FIG. 3, a strip 44 of resilient deformable material is affixed to the planar surface 38 of each of the pair of logs 30. The strip has a top surface 46 and a bottom surface 48 and is formed of a synthetic foam material. An adhesive coating 50 is applied to both the top surface 46 and bottom surface 48 of the strip 44. The strip 44 extends longitudinally along the base portion 36 of the pair of logs and extends transversely from one of the pair of arms to the other. The strip 44 is affixed to the planar surface 38 of each of the logs by the adhesive coating 50 on the bottom surface 48 of the strip 44. The strip is affixed to the planar surface to extend over each groove 42 of the center portion. Embedded in the center of the strip is a mesh substrate or scrim 52. The scrim 52 is formed of a flexible stretchable material such as nylon to provide strength and resistance to tearing.

Figure 5:
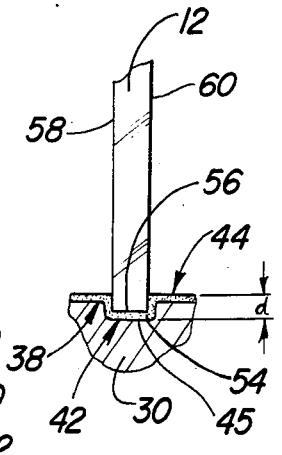
FIG. 5 is a partial fragmentary cross sectional view of a windshield supported in a groove of log of the invention taken along lines 5—5.

When the container is loaded, each lite is aligned within one of the plurality of slots and then lowered downwardly until the lite contacts and deforms a portion 54 of the strip 44 into the groove formed in the central portion, as best shown in FIG. 5. Since the bottom surface of each slot extends downwardly to the same level as the bottom of the respective groove, the portion 54 of the strip 44 is compressed into the groove 42 under a bottom edge 56 and between side surfaces 58 and 60 of the lite. The lite is, thus, held in position from longitudinal displacement by the compressed portion 54 of the strip. Additionally, the adhesive coating 50 on the top surface 46 of the strip 44 adheres to the side surfaces 58 and 60 and bottom surface 56 of the lite to further prevent longitudinal displacement of the windshield. The substrate or scrim 52 prevents tearing of the strip when the lite is lowered downwardly to compress the strip 44 into the groove 42. Each lite is, thus, supported by the pair of support portions 40 in a spaced apart vertical alignment from any adjacent lite.

After the pairs of logs have been loaded with lites, a spacer member 62 (as shown in FIG. 1) having a plurality of finger portions 64 is placed above the lites with the plurality of finger portions 64 extending downwardly between adjacent lites to prevent the tops of the lites from contacting each other. The top panel 24 and front panel 22 of the container 10 are then installed in position in the container and the panels of the container are wired or banded together. The container 10 is now ready for shipment. When the consumer wishes to unload the container, the container 10 is placed upon a conveyor and the top panel 24, front panel 22, and the spacer member 10 are removed. The lites are now accessible for removal and remain positioned within the container until needed for assembly into an automobile.

Additionally, the lites are securely supported by the pair of logs of the invention in the opened containers, so that the containers may be moved along the conveyors without any additional support for the lites. The containers may be also removed from the conveyors without additional supports for the lites.

It is to be understood that the forms of the invention herein shown described may be taken as preferred embodiments only, and that the various changes in shape, size and arrangement of the parts may be resorted to without departing from the spirit of the invention.

I claim:

1. A device for storage and transportation of a plurality of sheet members in a container, each of said plurality of sheet members having a top surface, a bottom surface and a pair of side surfaces, said device comprising:

an elongated log member having a base portion and at least one arm portion, said at least one arm portion having a plurality of spaced apart elongated slots, each of said plurality of slots being defined by a pair of parallel surfaces and a bottom surface, said pair of parallel surfaces spaced apart a predetermined width to abut said pair of side surfaces of each of said plurality of sheet members whereby each of said plurality of sheet members is supported by said pair of parallel surfaces in a spaced apart parallel relationship from each adjacent one of said plurality of sheets, said base portion having a generally planar surface and a plurality of spaced apart grooves, each of said plurality of grooves extending inwardly into said base portion from said planar surface, each of said plurality of grooves having a longitudinal axis extending through a corresponding one of said plurality of slots of said at least one arm portion whereby each of said plurality of grooves having a bottom surface and a pair of sides, said bottom surface of each groove being spaced a predetermined depth from said planar surface; and a resilient strip member having a top surface and a lower surface, said lower surface affixed to said planar surface of said base portion, said strip member extending across said plurality of grooves, said top surface of said resilient strip having a first adhesive coating, said strip member having a portion deformable to extend into each of said plurality of grooves when one of said plurality of sheet members is supported in said one of said plurality of slots and a respective one of said plurality of grooves, said portion of said resilient strip being compressed in said one of said plurality of slots between said bottom surface and said pair of side surfaces of said sheet member and said bottom surface and said pair of sides of said one of said plurality of slots so that said compressed portion of said strip and said first adhesive coating of said top surface adhesively contact said bottom surface and along a portion of said side surfaces of said sheet member to prevent longitudinal displacement of said sheet member.

2. The device of claim 1, wherein said lower surface of said strip member further comprises a second adhesive coating for adhesively affixing said strip member to said planar surface.

3. The device of claim 1, wherein said strip member further comprises:

a substrate member imbedded in said strip member for providing resistance to separation of said compressed portion of said strip member when said sheet member is positioned in said groove.

4. The device of claim 1, wherein said at least one arm portion is a pair of spaced apart arm portions.

5. The device of claim 1, wherein said bottom surface of each of said plurality of slots extends on a generally horizontal plane coextensive with said bottom surface of each of said plurality of grooves.

* * * * *